US012774609B1

(12) United States Patent
Klinger

(10) Patent No.: US 12,774,609 B1
(45) Date of Patent: Oct. 27, 2026

(54) UNIVERSAL SHORING POST ADAPTER FOR PALLET FRAME RACK

(71) Applicants: Shore Fit LLC, Avon, IN (US); Daniel V. Klinger, Avon, IN (US)

(72) Inventor: Daniel V. Klinger, Avon, IN (US)

(73) Assignee: Daniel V. Klinger, Avon, IN (US)

( * ) Notice: Subject to any disclaimer, the term of this patent is extended or adjusted under 35 U.S.C. 154(b) by 0 days.

(21) Appl. No.: 18/796,242

(22) Filed: Aug. 6, 2024

Related U.S. Application Data

(60) Provisional application No. 63/579,305, filed on Aug. 29, 2023.

(51) Int. Cl.
*E04G 25/02* (2006.01)

(52) U.S. Cl.
CPC ..... *E04G 25/02* (2013.01)

(58) Field of Classification Search
CPC ..... E04G 25/00; E04G 21/26; Y10T 292/65
USPC ..... 248/351, 354.1, 354.3, 354.4; 211/180; 52/146, 152, 127.2
See application file for complete search history.

(56) References Cited

U.S. PATENT DOCUMENTS 4,841,708 A * 6/1989 Johnston ..... E04G 1/12 52/646
6,135,419 A * 10/2000 Hutson, Jr. ..... B66F 3/24 254/133 R
7,913,463 B2 * 3/2011 Russell ..... E04G 17/14 52/651.1

* cited by examiner

*Primary Examiner* — Alfred J Wujciak
(74) *Attorney, Agent, or Firm* — Vangelis Economou; Economou IP Law

(57) ABSTRACT

A shore post engagement adapter and kit including such adapter for providing an engagement point to a damaged or collapsed pallet rack frame member two oppositely disposed side plates an engagement pin end and a pallet rack frame engagement end, the pallet rack frame engagement end having a predetermined array of small circular apertures and the engagement pin end having at least one large circular aperture, wherein the side plates engage the damaged rack frame member and attached thereto by the pins, the engagement pin bridges the span between the two engagement pin ends of the two side plates and which provides secure engagement of a shoring post to the adapter and to the pallet rack frame member.

4 Claims, 6 Drawing Sheets

UNIVERSAL SHORING POST ADAPTER FOR PALLET FRAME RACK

CROSS REFERENCE TO RELATED APPLICATIONS

This is a non-provisional of Provisional Application Ser. No. 63/579,305, filed Aug. 29, 2023, now, the entire specification of which is incorporated by reference herein as if fully set forth.

BACKGROUND OF THE INVENTION

1. Field of the Invention

This invention relates generally to an emergency device adapted to shore up a pallet rack structure and more specifically to such a structure used to provide momentary or temporary support to a collapsed pallet rack structure during an emergency or rescue operation.

2. Background Art

Pallet frame racks are material handling storage aid systems designed to store materials on pallets or skids. Many varieties of pallet frame rack systems are known, but all conventional systems provide storage of palletized materials in horizontal rows having multiple levels. Depending on the ceiling height, these may reach to as many as five or more levels, rendering the total height up to fifty feet, depending on the size of the items being stored thereon.

The pallets and items stored thereon are normally heavy, and at times very heavy. Thus, these systems are rigid, solidly built and assembled, and usually made of metal and can be securely bolted together for safety and ease of use. For example, roll formed selective rack systems are utilized in most storage facilities and bulk wholesale retailers. Because of almost continual loading, restocking and unloading of pallets, the pallet rack frames must be able to withstand shocks and bumps that occur regularly in storage places using the pallet rack storage systems. On occasion, the footings and lower section of a pallet frame rack may suffer damage from accidental collisions with transport equipment, such as the fork lift trucks, that are used for transporting pallets. Commonly owned and invented U.S. Pat. Nos. 10,974,352 and 11,691,229, the teachings of which are incorporated herein as if fully set forth, teach a method and kit for repair of damaged footings or upright sections of the pallet frames.

Repair of the upright pallet frame rack members is necessary to maintain integrity of the frames for continued use and to ensure the safety of users, workers and customers. Repair is only possible if the damage is relatively minor and the damaged portions can be buttressed and held together by repair of the damaged portions. On occasion, however, the damage to the uprights is so severe, that it creates a danger of complete collapse of the upright members or of the complete pallet frame rack, and the collapse endangers those who are in the vicinity of the tracks. On such occasions which experience total collapse of the pallet rack frame, all the items stored thereon are scattered to the floor of the facility. The weight of a collapsed rack frame may be dangerous to those in the vicinity. If anyone happens to be in the vicinity, the rack and items may fall around and on them, threatening life and limb.

In the event of such catastrophic collapse of the pallet frame rack, and especially if someone is either trapped by the rack frame and stored items, emergency first responder personnel who are called to the scene must act quickly and safely so as to stabilize the situation and prevent further damage in an unstable support situation. If anyone is trapped beneath the collapse, it is necessary to ensure that further shifting of the pallet rack frame and stored materials is avoided, since such shifting may cause further collapse and/or additional danger to any trapped victims. What is required in such emergency is equipment to momentarily stabilize and support the collapsed rack and to provide the opportunity to quickly alleviate the weight of the items on the persons trapped underneath, thereby to minimize further danger to life. Temporary supports and means to temporarily support damaged pallet rack frames are needed while the equipment to remove the pallet rack frame and stored items are brought to bear.

One problem in acting quickly in the emergent situation is that first responders, usually firefighters called to the scene, have limited equipment to shore up a collapsed rack frame. In most instances this comprises a shoring post, such as shoring post 80 shown in FIG. 6, which has a cleft end that is meant to securely engage parts of the rack frame and shore it up temporarily while any items scattered by the collapse are removed to alleviate the weight. However, and as is visible in FIG. 6 and in the figures of the aforementioned U.S. Pat. Nos. 10,974,352 and 11,691,229, unless the angle is accommodating, it is difficult for a first responder to find the right purchase on the usually diagonally extending parts of the rack frame because they have essentially rounded edges for purposes of safety.

Several known shoring regimes are known. For example, a height adjustable vertical shoring post is disclosed in U.S. Published Patent Application No. 2012/0042495 which has a quick release feature. These types of shoring posts are normally used in construction scaffolding to support the scaffolding levels, and cannot be utilized to support laterally, or in a non-vertical direction. Other shoring mechanisms utilized in the construction industry are provided in, for example, in U.S. Pat. Nos. 4,967,878 and 10,947,749 and in U.S. Published Patent Appln. No. 2012/10033125 disclose engineered shoring posts and bracket supports for use with semi-temporary structures such as construction scaffolding.

Different rack suppliers provide rack frames for their respective customers, as described in U.S. Pat. No. 7,771,152. Many rack frame systems are described in patents and publications, for example, in U.S. Pat. Nos. 4,341,313; 5,393,188, WIPO Publication No. WO2005095235A1 and others.

These different systems have different attachment mechanisms. For example, as shown in U.S. Pat. No. 9,999,301 and in aforementioned U.S. Pat. Nos. 10,974,352 and 11,691,229, a tear drop shaped aperture is used to connect different racks beam levels at the appropriate desired heights. However, the configurations may be different, even the for ones using similar attachment mechanisms. Thus, what is needed is an essentially universal adapter that can connect to as many as possible of the different types of rack frames as are commercially available. Depending on the connection points, and on how the adapter is capable of accommodating different connections mechanism, the adapter should ideally provide the necessary speed and security for first responders to quickly and effectively assist in an emergency situation and to save lives and alleviate a dangerous situation.

None of the prior art teaches providing an integrated system and equipment that is available to first responders that is capable of providing the necessary emergency capability to shore up a collapsed structure quickly, efficiently and without causing more harm. Ideally, the system is utilizable by first responders to provide for quick and efficient stabilization of a collapsed structure such that it stabilizes the static structure of the collapse as it reaches a rest position, thereby preventing it from further collapse. More particularly, such a system includes adapters that can be utilized with most rack frame members to provide a rigid, robust anchor that can accommodate most known shoring post ends to essentially freeze the positions of the collapsed frame members so that further movement of the collapsed structure is avoided and does no present any danger to those victims who may be trapped beneath or the first responders attempting to rescue the victims within the collapse zone.

SUMMARY OF THE INVENTION

Accordingly, there is provided herein a shore post engagement adapter for providing an engagement point to a pallet rack frame member, the rack frame member having at least one surface with through apertures, the adapter for use in an emergent pallet rack frame collapse, comprising a proximate side plate having a predetermined thickness, an engagement pin end and a pallet rack frame engagement end, the pallet rack frame engagement end having a predetermined array of small circular apertures and the engagement pin end having at least one large circular aperture, a distal side plate having a predetermined thickness an engagement pin end and a rack frame engagement end the rack frame engagement end having an array of small circular apertures and the engagement pin end having at least one large circular engagement aperture, at least two essentially cylindrical through pins sized and dimensioned for engaging at least two small circular apertures; and an engagement pin, sized and dimensioned for engaging the engagement aperture, wherein the proximal and distal side plates arrays of small circular apertures that in at least one orientation correspond to an array of through holes disposed in a surface of the rack frame member, such that overlaying the surface of the side plates over the array of through holes permits insertion of one cylindrical through pin through one of the small circular apertures of the proximate side plate, into the through apertures of the rack frame member, and into the small apertures of the distal side plate, thereby to firmly and robustly attach the adapter to the frame member, permitting secure engagement of a shoring post to the adapter and to the pallet rack frame member.

BRIEF DESCRIPTION OF THE DRAWINGS

The present invention will now be discussed in further detail below with reference to the accompanying figures in which.

DETAILED DESCRIPTION OF THE PREFERRED EMBODIMENTS

Figure 1:
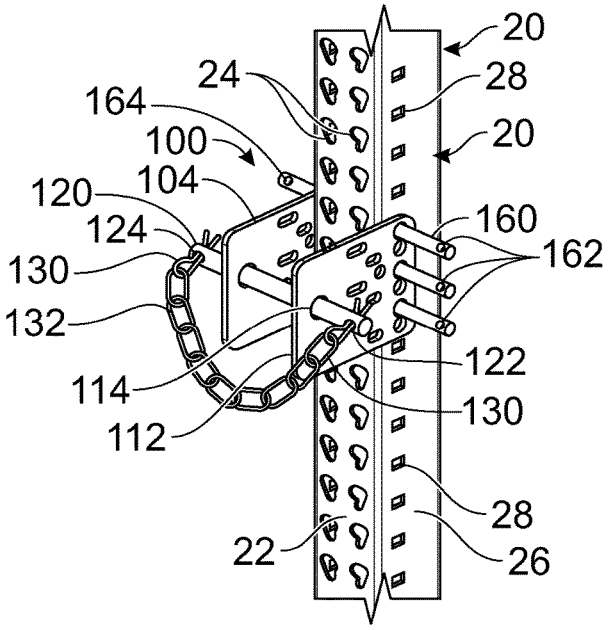
FIG. 1 illustrates a section of a vertical frame roll formed post utilizing the inventive adapters in a first configuration.
Figure 5:
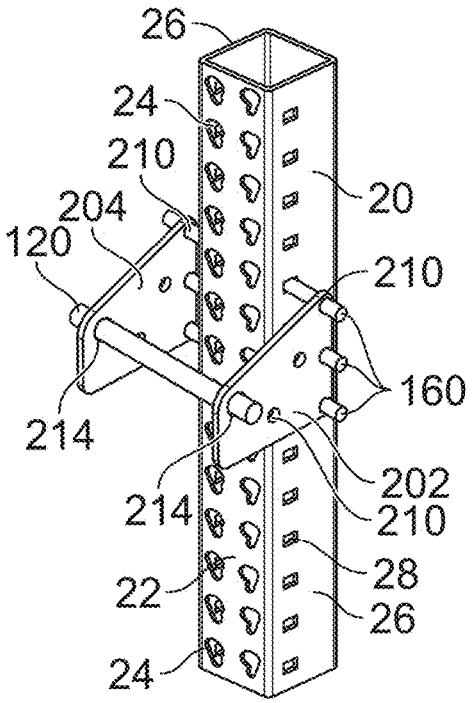
FIG. 5 illustrates a second embodiment of the inventive adapters used with a vertical section of a rack frame post in a first configuration.
Figure 17:
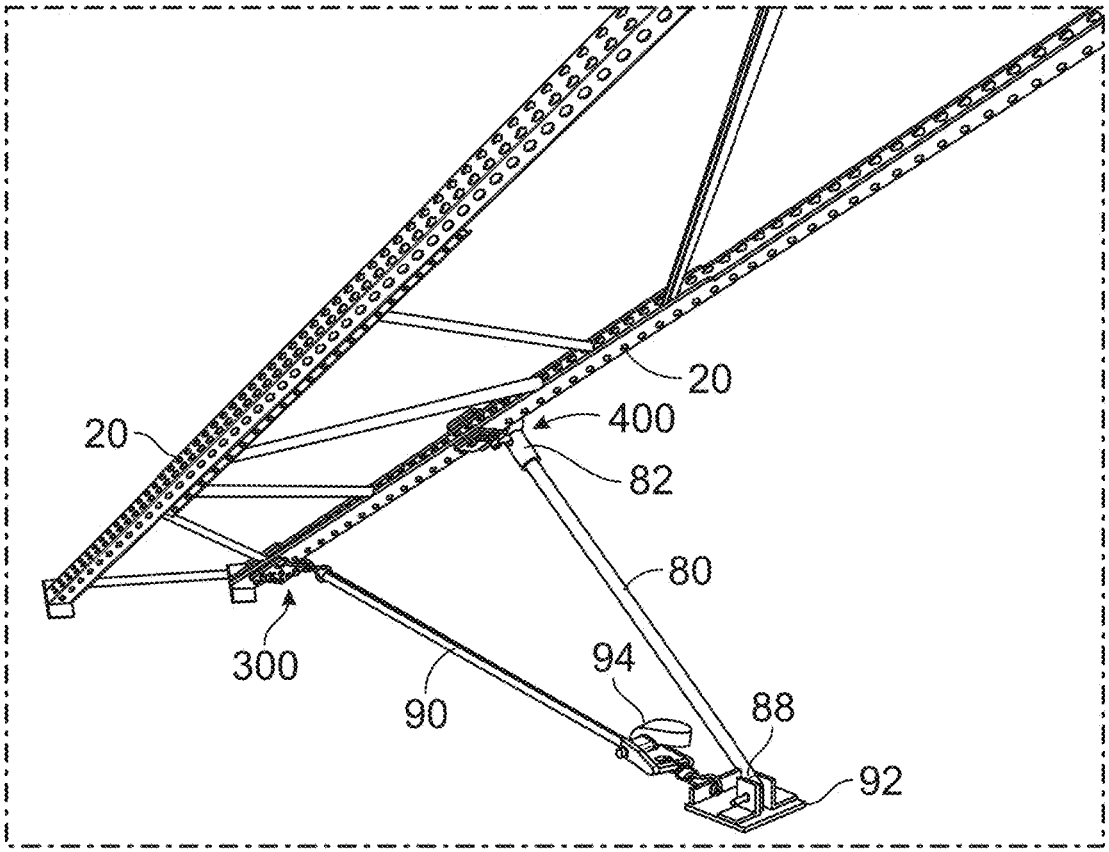
FIG. 17 shows a collapsed frame member being supported by a shoring post and engagement positions of the inventive adapters for supporting the collapsed frame member.
Figure 18:
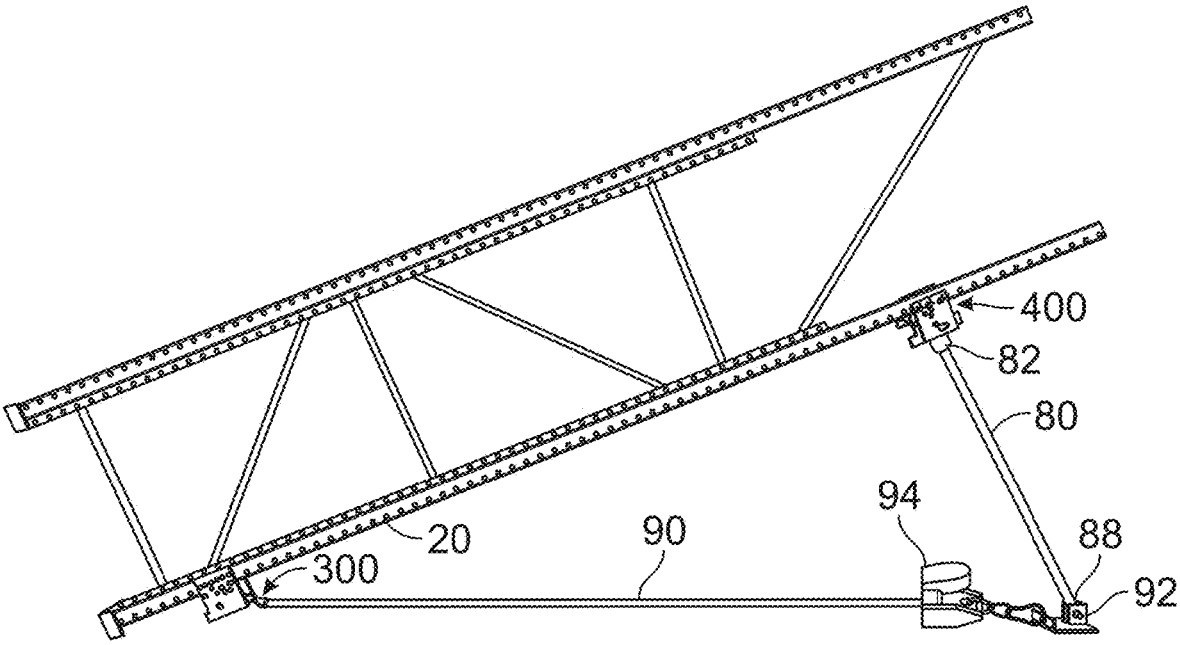
FIG. 18 shows a collapsed frame member being supported by a shoring post and engagement positions of the inventive adapters for supporting the collapsed frame member in a different configuration.

Referring now to FIG. 1, therein is illustrated a section of a vertical pallet rack frame section 20 and a first embodiment of the inventive adapters 100 shown in a first configuration. The pallet rack frame section 20 is shown as a discrete length of a pallet rack frame member for ease of illustration, it should be understood that it is but a short section of the complete frame member, as shown in aforementioned U.S. Pat. Nos. 10,974,352 and 11,691,229 and also in FIGS. 17 and 18 herein. In a catastrophic collapse of the frame rack, the complete frame member would typically be in a non-vertical position, as shown in FIGS. 17 and 18, and the adapters, for example, adapters 100, would be used to provide a sturdy engagement point for the shoring post 80, as shown in FIGS. 5, 17 and 18.

Referring to FIGS. 1-4 collectively, all of the rack frame sections 20 are shown for ease of illustration as extending in a vertical direction. However, after a rack frame collapse, the exact angle of a rack frame member relative to the ground is highly unpredictable. Thus, a shoring post, such as shoring post 80 (FIG. 6) in order to have a sturdy engagement point on the rack frame member 20 to shore up the collapsed rack frame, the angle of the rack frame member that needs shoring up may not be in an ideal position, and it may prove difficult to provide a sturdy engagement to safely shore up a collapsed rack frame. In those instances, it is necessary to provide a secondary engagement point by attaching a sturdy and robust engagement member, such as adapter 100 (FIG. 1), to one or more rack frame members to which the end 82 of shoring pole 80 (FIG. 6) may be applied to provide the shoring function.

Also, because of different configurations and shapes of the frame members, it may not be possible to have a single adapter for engagement of the shoring pole end 82. For example, see the different types of rack frame members 20, 30, 40 in each of the embodiments shown in FIGS. 1, 3 and 4, respectively. For those different types of rack frame members, it may be necessary to provide an adapter that is capable of accommodating different frame aperture configurations, as does adapter 100 accommodating the widely used roll formed post "tear drop" configuration (FIGS. 1, 2) and alternative configuration of FIG. 4. As shown, the same adapter 100 is capable of use with different rack frame systems in these figures as long as the apertures can be aligned to coincide for insertion of the various pins, as will be explained below.

For ease in description in not having to repeat the parts structural and functionally, those parts that are identical between the different figures, such as rack frame member 20, will retain the identical part identification. When parts in distinct embodiments are similar but not identical in shape and function, similar numbering regime will be indicated with a different prefix in the first digit.

Referring now to the adapter 100 as shown in various attachment configurations in FIGS. 1, 2, 4 and 9, the adapter 100 shown in FIG. 4 will be described as showing the most accessible view. Adapter 100 comprises two side plates 102, 104, each made of a metal sheet having a thickness in a range of from ¼ to ¾ inches, with a preferred thickness of about ½ inch. having several apertures extending therethrough. The side plates 102, 104 are essentially identical to each other and differ in positioning relative to the surfaces of various rack frame members. The structure of side plate 102 is most apparent in FIG. 4 and will be discussed in detail, with the understanding that the structural details also apply to side plate 104.

The side plate 102 comprises essentially a square with edges having length and width in a range of from 6-10 inches, with a preferred edge dimension of about 8 inches. Each side plate 102, 104 has several apertures of different sizes drilled therethrough for receiving cylindrical pins of different diameters as will be explained below. These include small circular apertures 110, oval apertures 112 and a large circular aperture 114. The sizes, disposition, spacing and orientation of apertures 110, 112, 114 are specifically prearranged to coordinate with throughholes of various known pallet rack frame configurations. As shown in FIG. 4, specific ones of apertures 112 and 114 align with specific throughholes 32 extending through a front facing surface 34 of rack frame member 30. Ideally, the diameters of small circular apertures 110 and throughholes 32 are both of similar sizes, so as to receive through pins 160 therethrough.

Through holes 112 are oval in shape to provide some room for adjustment of the lateral position of the through pin 160. The orientation of the oval through hole 112 is such that it accommodates any slight discrepancy in the spacing of through holes 32 in the surface 34 of the upright frame member 30. As a result of the identical aperture spacing in both the forward side plate 102 and the back side plate 104, the through pin 160 will be able to pass through the apertures 112, and 32. Once all the through pins 160 are inserted into through all the apertures 110, 112 and 32, the relative positions of the side plates 102, 104 are parallel to each other with a spacing of about 3 to 5 inches between them and the apertures 110, 112 and 114 are all aligned, thereby to fix the side plates in the desired configuration.

Figure 2:
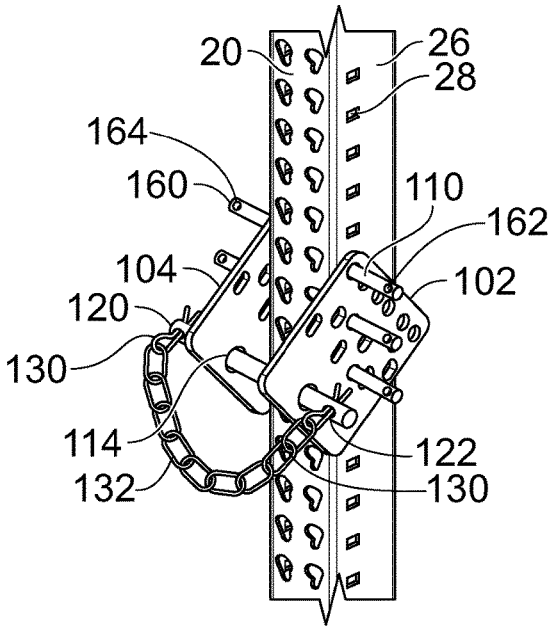
FIG. 2 illustrates a vertical section of a frame roll formed post utilizing the inventive adapters in a second configuration.

Optionally and preferably, each pin 120, 160 includes cotter pin holes 122, 124, 162 adjacent each end to permit insertion of cotter pins (FIGS. 1, 2). Through pins 160 may have cotter pin holes 162, 164 drilled therethrough at either or both ends, as shown in FIGS. 1 and 2. Cotter pins 130, or alternatively split pins (not shown), are connected through the cotter pin holes 162, 164 (see also FIG. 12B). After the through pins 160 are inserted into all the through holes 110, 112, 28, the cotter pin holes 162, 164 extend beyond the outer surfaces 26 of side plates 102, 104 and are ready for the insertion of the through pin cotter pins (not shown for clarity). As shown and described only with respect to engagement pin 120,, the ends 126 (FIG. 12C) of pin 120, extend outwardly from either side of the outer surfaces 26 of the side plates 102, 104 with cotter pin holes 122, 124, 162, 164 (FIG. 12) being disposed in the extended sections of the pins 120, 160. Cotter pins 130 serve to fix the position of the engagement pins 120, and also through pins 160, so that they cannot come loose and or fall out of their engagement of the adapter to the pallet rack frame member 20. For convenience, the two cotter pins 130 for adapter 100 are shown connected to each other by a chain 132 or other flexible connector which is long enough to span the distance between the two side plates 102, 104.

Referring again to FIG. 4, this configuration causes the large circular aperture 114 of side plate 104 to extend beyond the distal edge 34 of pallet rack frame member 30 so that the distal end of side plate 104 is cantilevered over the edge 34 of the pallet rack frame member 30. When the rest of the through pins 160 are inserted, the two large circular apertures 114 of the two side plates 102, 104 align in a straight line between the two cantilevered ends of the side plates 102, 104. This alignment enables insertion of engagement pin 120 through the two large circular apertures 114 to form a bridge on the cantilevered ends of the side plates 102, 104. The tolerances of the through holes 110, 112, 114 are such as to closely match the diameters of the clevis or through pins 160, 120 and thus once these are inserted, the structure of the adapter 100 provides a firm and robust connection to the rack frame member 30, which provides for a sturdy structural frame connection. The first responder can then utilize the engagement pin 120 to provide a point of purchase for the shoring post (FIG. 6) and thus to shore up the structural pallet rack frame member 30, as will be described below.

As discussed above, the adapter structure is versatile enough to enable the first responder to attach it to different types of pallet rack frame members. Referring now to FIG. 1, rack frame member 20 has a different configuration from structural rack frame member 30 (FIG. 4). Pallet rack frame member 20 is usually roll-formed and comprises a square tubular shape having a normally front facing surface 22, on which "tear drop" apertures 24 are arrayed in two rows along the longitudinal direction of the front face 22. Apertures 24 have a predetermined spacing between them in both the lateral and longitudinal directions. Adapter plates 102, 104 include small circular apertures 110 which may align with the spacing regime of the tear drop apertures 24, thereby allowing the adapter 100 to be positioned and attached to the front face 22 of rack frame member 20 if the engagement pin 120 is desired to attain a position appropriate for shoring up a collapsed rack frame member similar to that discussed in reference to structural rack frame member 30 (FIG. 4).

However, if the pallet rack frame member 20 is positioned and oriented such that the shoring post 80 (FIG. 6) needs to shore up the collapsed rack frame member in a different orientation, the adapter 100 may be connected to the rack frame member 20 in at least two different ways. As shown in FIG. 1, the rack frame member 20 also includes two side surfaces, on side surface 26 being visible in FIG. 1. Side surfaces 26 also include a single row array of round (not shown) or square shaped apertures 28 that extend longitudinally along the surfaces 26 of pallet rack frame member 20. While these apertures 26 are shown as square, any shape aperture 26 may be disposed along the front edge of the surface 26, the shape not being significant as long as the dimensions are sufficiently large to snugly receive a through pin 60 therethrough.

As is seen in FIG. 1, the through holes 28 align with a corresponding through holes on the opposite side surface 26 the rack frame member 20, such that a through pin 160 may be inserted through the rack frame member 20. Three or more through pins 160 are inserted in adjoining through apertures 28, and corresponding through holes 110 on the side plate 102 are aligned with the through pins 160 such that the side plate 102 can be brought close to the side surface 26 of rack frame member 20. Similarly, a second side plate 104 is slid over the through pins 160 on the distal side surface of the rack frame member 20 until it abuts the side surface on that side.

Once the side plates 102, 104 are in engagement with sides 26 of the collapsed rack frame member 20, the large circular apertures 114 of plates 102, 104, each located at an engagement pion end of the side plates 102, 104, should align in position to receive the engagement pin 120. Engagement pin 120 is inserted through the large circular aperture 114 of the side plates 102, 104 thereby to provide an engagement point that is oriented in the desired direction for the shoring post 80 (FIG. 6) which is a standard emergency tool bright by first responders to any emergency situation.

Once the correctly oriented engagement pin 120 is engaged by the end 82 of the shoring post, which is then firmly wedged against an immovable object, such as the floor, the risk of further collapse of the rack frame is minimized and thus can provide a safe work area for first responders to complete their tasks, such as removing stored items and raising the collapsed rack fame from a victim unfortunate to be trapped within. As can be appreciated, the engagement point that is presented for attachment of emergency tools, such as shoring pole 80 (FIG. 6), must present an appropriate angle to allow the shoring post 80 to have sufficient purchase to hold up the frame member and provide robust support between the ground and the engagement point so as to avoid further collapse.

To ensure that the engagement pin 120 has a desirable and secure orientation for the shoring post 80, the inventive adapter 100 must be versatile enough to connect to the rack frame member 20 in different orientations. Referring now to FIG. 2, the rack frame member 20 may be oriented in a way that shoring pole 80 does not have the greatest purchase in the engagement. Other difficulties may present themselves in reaching a secure engagement of the shoring post end 82 (FIG. 6), such as obstructions may prevent the implementation of the configuration of FIG. 1, so that an alternative configuration is needed. Thus, the adapter 100 may be reconfigured using the same parts as used in the configuration of FIG. 1.

Specifically, the arrangement of small circular apertures 110, 112 on side plates 102, 104 lend themselves to appropriate angular rotation of the side plates 102, 104 to reposition the engagement point for the shoring post end 82, all the while providing a secure and robust engagement of the shoring post to the adapter and through its connection to the rack frame. As is shown in FIG. 2, the two side plates 102, 104 are angularly rotated relative to the rack frame member 20 by about 45°. Appropriate ones of the small circular apertures 110, 112 are chosen to engage the through pins 160, which are inserted into up to three adjoining through apertures 28, bringing side plates 102, 104 into abutting relationship with side surfaces 26 of the rack frame member 20, as in the embodiment of FIG. 1, albeit in a rotated configuration. The preferable additional step is to secure the engagement pins 160 in place by inserting the through pin cotter pins (not shown) through the cotter pin holes 162, 164.

Figure 6:
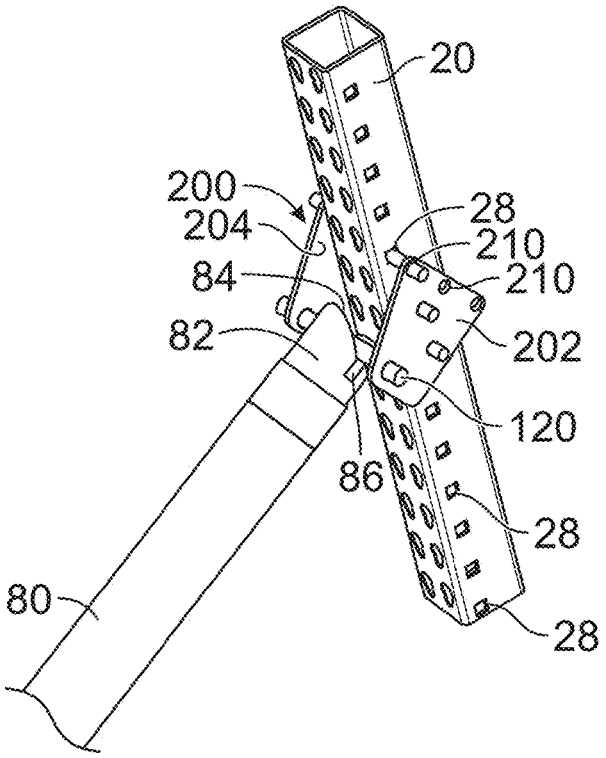
FIG. 6 illustrates in a perspective view the second embodiment of the inventive adapters of FIG. 5 in a supporting configuration used with a shoring post to support a diagonally extending section of a rack frame post.

Once side plates 102, 104 are securely attached to the rack frame member 20, the engagement pin 120 is then inserted aligned large circular apertures 114 to provide the bridge between the two side plates 102, 104, thereby to provide the necessary engagement point for the shoring post end 82 (FIG. 6). With this configuration, the versatility of the adapter 100 provides secure engagement regardless of the angular position of the rack frame member 20, which then allows the first responders to safely continue with their emergency services.

Figure 3:
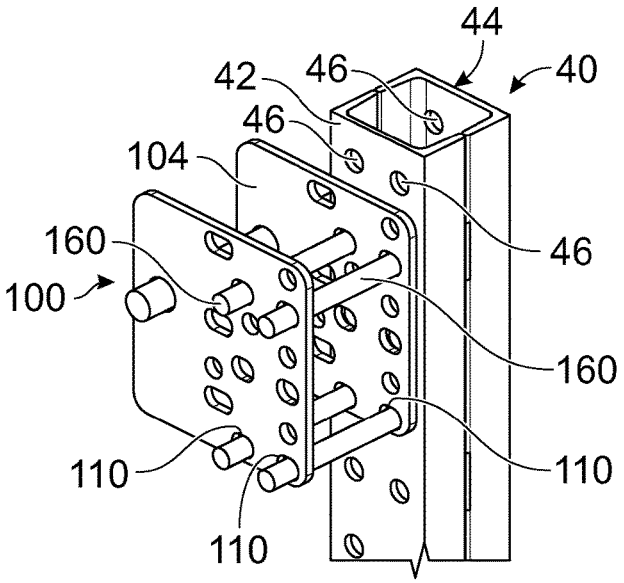
FIG. 3 illustrates a vertical section of a rack frame reinforced structural post utilizing the inventive adapters in a third configuration.

The inventive adapter 100 further lends itself use with other types of rack frame members, such as member 40 shown in FIG. 3. Rack frame member 40 is in the shape of a square tube having a front face 42, and an oppositely disposed rear face 44. Both faces 42, 44 include an array in two rows of through apertures 46 which are shaped, dimensioned and oriented to receive through pins 160. In engaging the adapter 100 to the front surface 42 of frame member 40, pins 160 may be inserted first into the small circular apertures 46, which are aligned back to front. The rear side plate 104 may then be slid over the pins 160 so that small circular apertures 110 align with the through apertures 46 until the back surface (not shown in FIG. 3) abuts front surface 42 of pallet rack frame member 40.

Following engagement of the surfaces, the front side plate 102 is then slid over the through pins 120 leaving a predetermined gap between plates 102, 104. Proper alignment of plates 102, 104, will also align the large circular apertures 114 of the two plates 102, 104 allowing insertion of the engagement pin 120 therethrough to form the bridge therebetween. The engagement pin 120 is thus ready to support the end 82 of shoring post 80 (FIG. 6) in a sturdy and robust engagement, as with the other embodiments shown in FIGS. 1, 2 and 4.

Referring now to FIG. 5, another embedment of the adapter 200 is shown working in tandem with a shoring post 80 to shore up a collapsed or wobbly rack frame member 20, similar to the rack frame member of FIGS. 1 and 2. The shape of adapter plates 202, 204 is slightly different from that of adapter 100, including the spacing and orientation of the small circular apertures 210. The identifying numerals of the adapter 200 follow the numbering of the FIGS. 1-4 adapter, but will have a different prefix in the 200 series. Functionally the two adapter embodiments are essentially identical, with adapter 200 being more simplified and less versatile than adapter 100.

Adapter 200 also comprises two side plates 202, 204 having essentially an identical configuration of small circular apertures 110 in two rows, a vertical array of three adjacent apertures and a diagonal row, with an apex aperture 110 being common to both rows. The limited number and orientation of apertures 110, and the lack of any oval apertures, such as oval apertures 112 (FIG. 4), restricts the number of different rack frame members that adapter 200 may be used with. Nevertheless, and especially if the adapters are made available to local first responders at a dedicated facility having only a single type of rack frame, adapter 200 may be sufficient for the purpose and indeed may be easier to attach.

Figure 8:
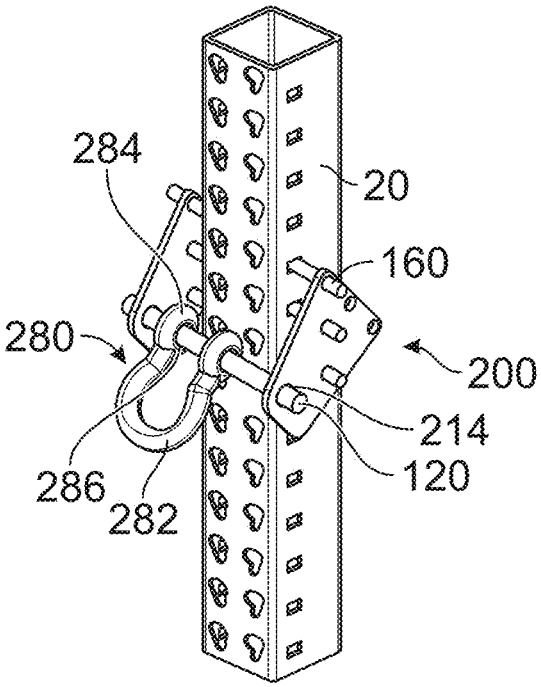
FIG. 8 illustrates in the second embodiment of the inventive adapters used with a vertical section of a rack frame post in the second configuration utilizing an engagement hook or buckle.

As in the vertically oriented adapter of FIG. 1, through pins 160 are inserted into the square apertures 28 so as to extend across the gap between and beyond the surfaces 26. Three pins are shown in adjacent through apertures 28, but it will be readily understood by a person of ordinary skill that two pins may be sufficient to fix the adapter 200 to the rack frame member 20, and more pins and apertures may be included if a more secure attachment is desired. Side plates 202, 204 are then slid over the pins, making sure the alignment is correct and provides a sturdy connection to the pins 160. Once the plates 202, 204 are properly disposed and secured, and the large circular apertures 214 are in alignment, the engagement pin 120 is inserted into the large circular apertures 214 to provide the bridge between the plates 202, 204, thereby providing an attachment point for the shoring post (FIG. 6). It should also be noted that plates 202, 204 are not disposed so that the surfaces of the plates abut the side surfaces 26 of the rack frame member, but instead are spaced therefrom a short distance. This will be important in providing some leeway between the plates 202, 204 to enable insertion of shackles, hooks, etc., as shown in FIG. 8.

Figure 7:
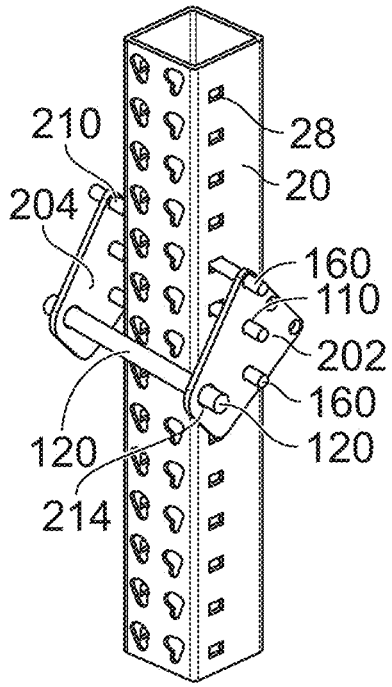
FIG. 7 illustrates the second embodiment of the inventive adapters used with a vertical section of a rack frame post in a second configuration.

Referring now to FIG. 7, identical parts are used but in a different, diagonal, configuration. That is, instead of the vertical small circular apertures 110, the diagonal row of apertures 110 are aligned with the through apertures 28 of the rack frame member 20, so that the engagement pin 120 is much closer to front surface 22 of the rack frame member 20. This may be desirable if there is no clearance for the more expansive configuration of FIG. 5 or if the angle is better suited for engagement of the end 82 of shoring pole 80 (FIG. 6).

Referring now to the perspective view of a collapsed or leaning rack frame member 20 that is in need of shoring, and after the adapter 200 is secured to the rack frame member 20 as described in reference to FIG. 7, a shoring post 80 mechanism is brought to bear to provide support to the collapsed frame. The shoring post 80 may comprise a simple shoring post as normally used by first responders, as shown, or may be a part of a more elaborate mechanism, such as that shown and described with reference to FIGS. 17 and 18 below.

In the embodiment of FIG. 6, the shoring post 80 having an end 82 with a V-shaped cleft indentation 84 that is capable of engaging the engagement pins 120 of any of the embodiments of this invention so as to shore up a collapsed rack frame. The end 82 with the cleft 84 engages the pin 120 and the other end (not shown) of the shoring post is brought into engagement with a sturdy, and ideally immovable backstop, such as the floor, to restrain the rack frame from further movement or collapse. This position of the shore post 80 may be temporary while other shoring mechanisms, such as those shown in FIGS. 17 and 18 are brought into the mix.

The end 82 of shoring post 80 may include a crevice 86 having an opening at the point of the V-shaped cleft 84 that is capable of securing the engagement pin 120 therein. With a position of the angle in the desired direction, that engagement may be more secure and could also restrain further shifting of the rack frame member 20 by minimizing any twisting action.

Referring now to FIG. 8, an adapter 200 is illustrated having an identical installation of the configuration shown in FIG. 7 as an example of the versatility of the inventive adapter. One major difference lies in the insertion of a U-shaped shackle 280 into the adapter structure which can be used for engagement of a shoring post as an alternative to engagement with the engagement pin 120. Shackle 280 comprises a semicircular engagement section 282 that can readily receive the end of a shoring post 80 (FIG. 6). Disposed at either end of the U-shaped semicircular engagement section 282 is a circular loop 284 having a centrally disposed engagement aperture 286 having a diameter dimensioned and oriented to receive the engagement pin 120 therein. To achieve this, the axis or centerlines of the two apertures 286 are aligned, and the diameter of the circular apertures 286 are slightly smaller than the diameter of the engagement pin 120.

Figure 4:
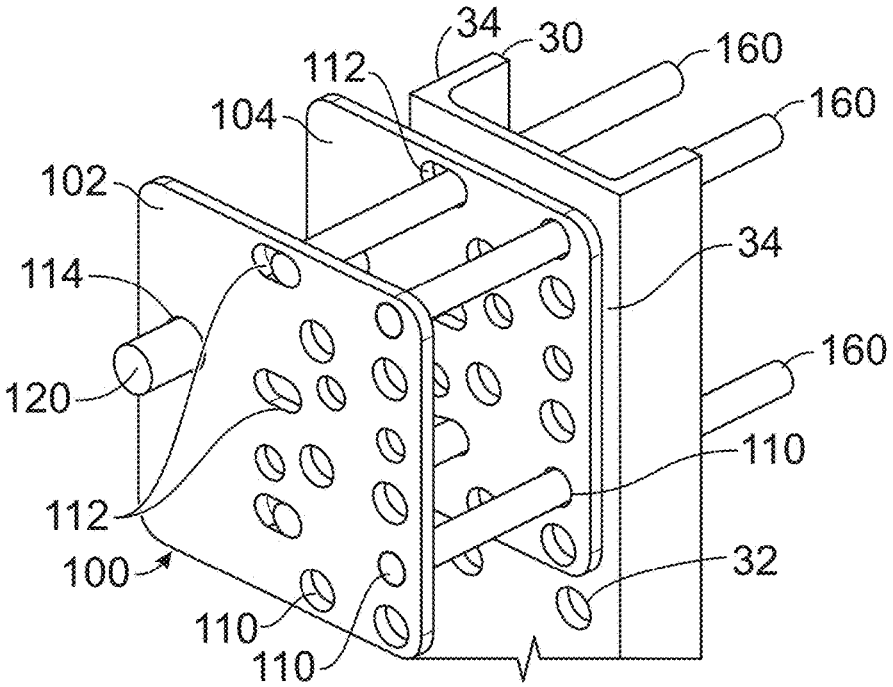
FIG. 4 illustrates a vertical section of a different type of rack frame structural post utilizing the inventive adapters in a third configuration.
Figure 9:
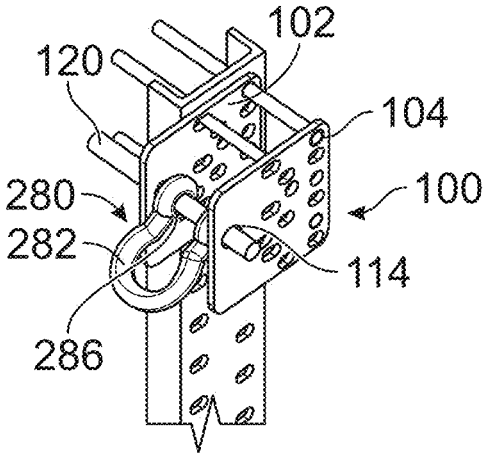
FIG. 9 is a perspective view of the inventive adapters in the third configuration as shown in FIG. 3 and utilizing an engagement point or shackle.

Referring now to FIG. 9, adapter 100 is attached to a rack frame member 30 essentially as in the embodiment shown in FIG. 4, with a difference in that shackle 280 is connected to engagement pin 120, as in FIG. 8. Shackle 280 includes the semicircular engagement section 282, and disposed at each end of the U-shaped semicircular engagement section 282, a circular loop 284 with a centrally disposed engagement aperture 286 having a diameter dimensioned and oriented to receive the engagement pin 120 therein. In use, the adapter 100 is installed on the frame rack member 30 as described in reference to FIG. 4, with a slight modification of the steps before the insertion of the engagement pin 120 into the large circular apertures 114. That is, before the insertion of engagement pin 120, the shackle 280 is positioned in the gap between the two side plates 102, 104 such that the centrally disposed engagement apertures 286 are coaxially aligned with the centerline axis of the apertures 114. This positioning will align the apertures so that when the engagement pin 120 is inserted into the first aperture 114, then into the two circular apertures 282 and then again into the corresponding aperture 114 of the other plate, the shackle 280 is firmly attached to the engagement pin 120, which itself is robustly connected to the adapter 100. This shackle can now be used to provide a better engagement point of the end 82 of the shoring post 980, or alternatively to a rope or other flexible length of cord that can be secured to a stable anchor (not shown).

Figure 10:
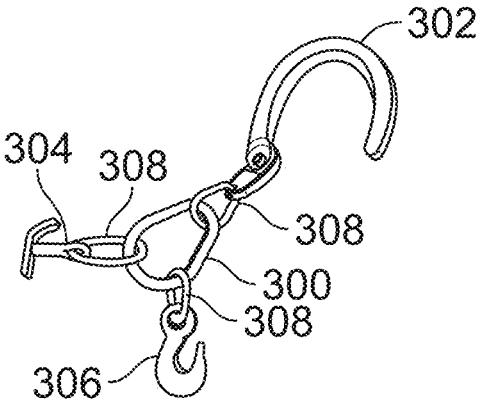
FIG. 10 PRIOR ART
FIG. 10 shows a plurality of prior art hooks connected to a common ring for use with the appropriate pin.

Referring now to FIG. 10, a commercially available ring 300 or other type of connector is shown with several different types of hooks 302, 304, 306 attached thereon by means of carabiners 308. The hooks can be used to attach to the engagement pin 120 of any of the above-described embodiments as shown in FIG. 1-7, or the shackles 280 as shown in FIGS. 8 and 9. Hooks 302, 304, 306 have different shapes, and may be used for providing different engagement points in order to secure the collapsed rack frame. For example, hook 302 may be used to engage the body of a shoring post 80 so as to hold it in place by a second engagement at another point (not shown) on the pallet rack frame member, or to a different collapsed rack frame member. Hook 306 may be used to engage a cord or a hook onto a chain link for a chain (not shown) or other flexible lengthy material as will be described below with reference to FIGS. 17 and 18. This conventional hook system is capable of connecting to the rescue adapter 100, etc. in certain situations when additional force may be necessary given the specific situation considerations.

The process of connecting the adapter 200 to a rack frame member 20 is identical to that described above with reference to the embodiment of FIG. 7, until the insertion step of the engagement pin 120 through the large circular apertures 214. At this step, the shackle 280 is positioned between the two apertures 214 so that the apertures 214 and the apertures 286 of shackle 280 are in a position that their axes are contiguous and coterminously aligned. This will permit insertion of the engagement pin 120 through the first large circular aperture 214, then through the circular apertures 286 of the two loops 284, and finally through the second large circular aperture 214 of the opposite side plate. At that point, the adapter has fully engaged the collapsed pallet rack frame member, and the shackle 280 can be used to provide support from above or below.

Figure 12A:
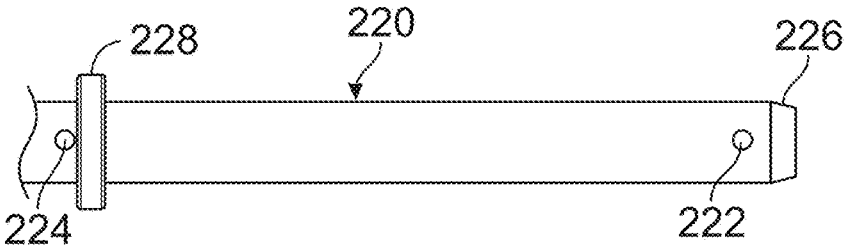
FIG. 12A shows in a side view a second embodiment engagement pin used to engage the shoring post ends.
Figure 11:
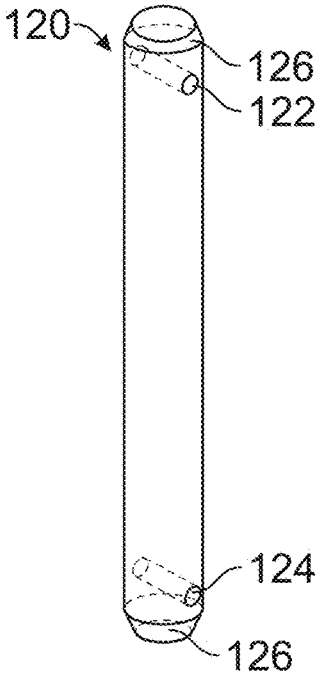
FIG. 11 shows in a side view a first embodiment of a pin used to engage the shoring post ends.

Referring now to FIGS. 11 and 12A, engagement pins are shown having specified shapes and dimensions ideally suited to the function of engagement pins 120, 220, respectively. Ideally, the pins 120, 220 are cylindrical with an elongate shape and having a diameter much smaller than their length so as to enable their insertion into the large circular apertures 114, 214, etc. Engagement pins 120, 220 necessarily must have a diameter sufficiently large so as to be able to robustly retain engagement with either the shoring post end 82 (FIG. 6), flexible cord or cable, as the case may be, while also withstanding the large weight and loads that may be present from the collapsed structure and stored materials. That diameter should be in a range of from 0.5 inches to 1 inch, with the preferred diameter being about 0.74 inches. This will permit the large circular apertures 114, 214 to be at the ideal diameter of ¾ (0.75) inch, thus allowing a slight clearance for easy insertion of the engagement pins 120. Also providing for easier insertion of engagement pins 120, 220 into the respective large circular apertures are beveled ends, 122, 222. The bevel angle of beveled ends 126,226 is appropriately at an appropriate angle that permits the insertion into apertures 114, 214, and which widens to the full pin diameter as the insertion proceeds. FIG. 12A illustrates a similar engagement pin 220 to that of pin 120 in FIG. 11, with the addition of an annular flange 228 close to the end of the engagement pin 220, disposed opposite the beveled end 226. Annular flange 228 acts as a stop to further insertion of engagement pin 220 beyond the side plate surfaces so that it remains in place in the event that the cotter pins (not shown) are not used or are not available.

The length of engagement pins 120, 220 should be long enough to span the divide between any two side plates, in a range of from 5 to about 10 inches, with a preferable length of about 6 inches to about 6.75 inches. Two cotter holes 124 and 224, 226, respectively, are optionally drilled through the pins 120, 220 very close to the ends for insertion of cotter pins (not shown) once the engagement pins 120, 220 are in place between the two side plates. The cotter holes 124, 224, 226 are positioned so that they will be disposed outside of the end plates and the cotter pins (not shown) will ensure engagement pins 120, 220 do not fall out during emergency action. Ideally, engagement pins 120, 220 will comprise a strong metal, such as stainless steel or hardened steel capable of withstanding the large loads that will be exerted thereon.

Figure 12B:
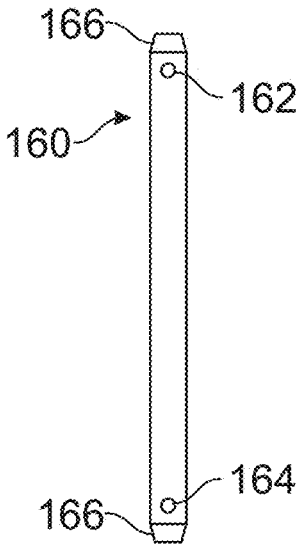
FIG. 12B shows in a plan view a through pin used to connect the adapter side plates to the pallet rack frame member

FIG. 12B illustrates a through pin 160 having beveled ends 166. Two cotter pin holes 162, 164 are drilled through the diameter of the cylindrical pins 160 adjacent the beveled ends 166. The cotter pin holes 162, 164 are capable of receiving cotter pins 130 (FIGS. 1 and 2) therein.

Figure 12C:
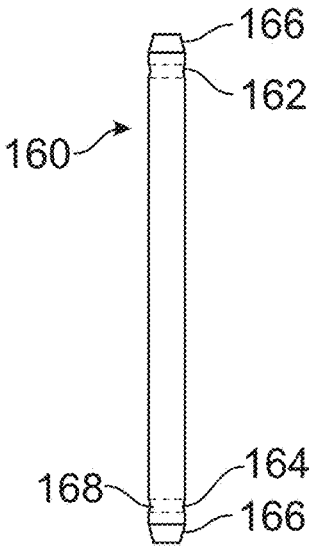
FIG. 12C shows in a plan view a second embodiment engagement pin used to engage the shoring post ends.

FIG. 12C illustrates a through pin 160, similar to that of FIG. 12B, with the addition of annular grooves 168 close to the beveled ends 166 of the through pin 160, such that the groove 168 overlaps the cotter pin hoes 162, 164. Annular grooves 168 act as an indicator of the position of the cotter pin holes 162, 166. This provides a quick gauge of the cotter pin hole positions and provide for easy location of the cotter pin holes when the cotter pins are being inserted therein.

The length of engagement pins 120, 220 should be long enough to span the divide between the two side plates, in a range of from 5 to about 10 inches, with a preferable length of about 6 inches to about 6.75 inches. Two cotter holes 224, 226 are optionally drilled through the pin very close to the ends for insertion of cotter pins (not shown) once the engagement pins 120, 220 are in place between the two side plates. The cotter holes 224, 226 are positioned so that they will be disposed outside of the end plates and the cotter pins will ensure that engagement pins 120, 220 do not fall out during the first responder rescue activity. Ideally, engagement pins 120, 220 will comprise a strong metal, such as stainless steel or hardened steel capable of withstanding the large loads that will be exerted thereon.

Figure 13:
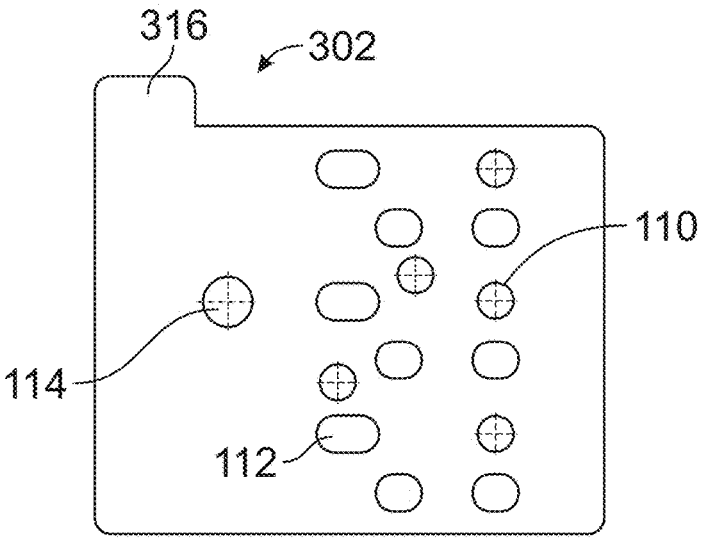
FIG. 13 shows in a perspective view another embodiment of the inventive adapter.
Figure 16:
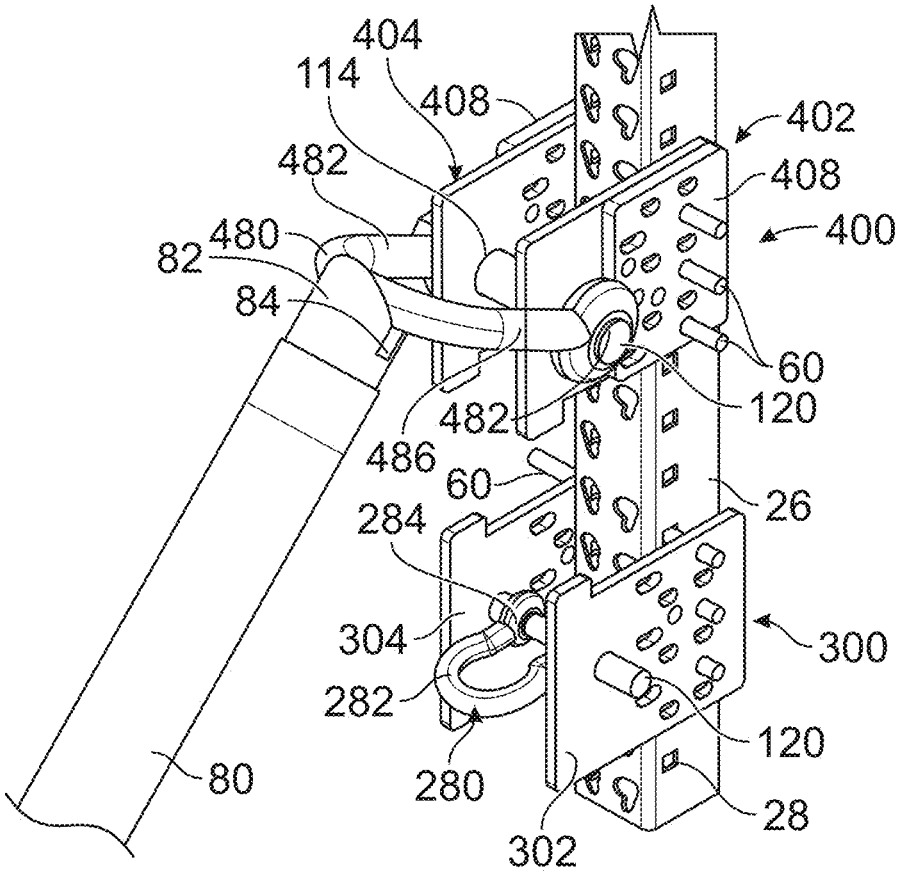
FIG. 16 shows in a perspective view a vertical section of a rack frame post in the two additional configurations utilizing engagement hooks for engaging a shoring post.

FIG. 13 is a front view of yet a different embodiment of a side plate 302 showing a pattern of placement of small circular apertures 110, 114, and large circular aperture 114. In the view of side plate 302 shown in FIG. 13, an extension 316 protrudes from one corner of the side plate, which aids in the orientation and disposition of the side plates in the stress of an emergency situation, as will be explained in relation to FIG. 16 showing these side plate embodiments in use. An additional feature provided by the extension 316 when provided in each of the side plates is that it can act, when it is oriented at the lowest position, as in the top adapter 400 of FIG. 16, as a secondary contact point for the end 82 of a shoring post 80. The configuration shown in the top adapter FIG. 16 provides for an underside notch between extension 316 of side plates 402, 404 that can function as an additional option for engagement using the edge of a side plate instead of engagement with the engagement pin 120. Extension 316 in the edge of the side plate 302 as shown in FIGS. 13 and 16 provide for another alternative engagement point for the end 82 of the shoring pole 80 when specific site conditions could benefit from this option due to the orientation of the collapsed pallet rack frame.

Figure 14:
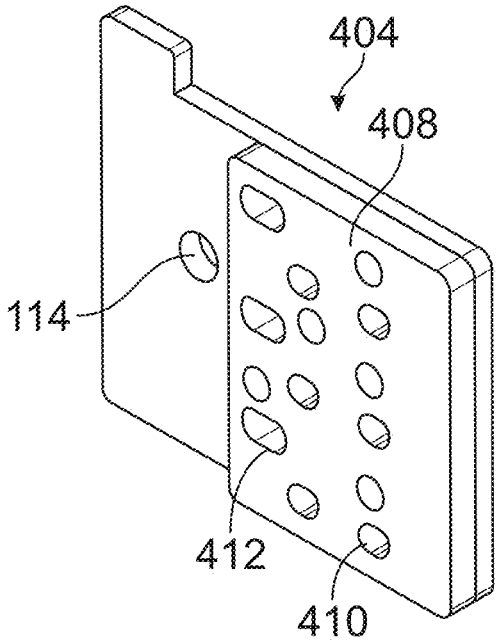
FIG. 14 shows in a perspective view still another embodiment of the inventive adapter.
Figure 15:
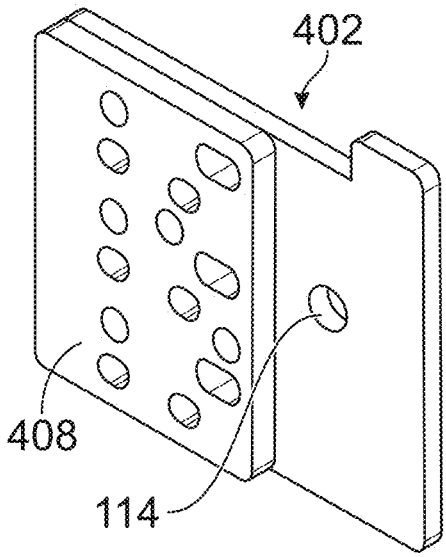
FIG. 15 shows a side plate in a perspective view yet another embodiment of the inventive adapter.

FIGS. 14 and 15 illustrate in perspective views alternative embodiments of the side plates 302. Side plates 402, 404 include the embodiment of the side plate 302 shown in FIG. 13, but also each one includes a shim 408. Shim 408 has dimensions on three sides that essentially match the edge dimensions of three of the sides of the side plates 402, 404, but does not extend beyond a middle section of the plates 402, 404. It should be noted that the small apertures 110, 112, of the side plate 402, 404 have corresponding apertures 410, 412 that exactly match the positioning, orientation and size so as to permit insertion of pins 160. The position of shim 408 leaves uncovered that end of the plate 402, 404 so that shim 408 does not overlay that end of side plates 402, 404 having the large circular aperture 114. The reason for this structure is to provide clearance for the shoring pole 80 (FIG. 16) as will be explained in relation to the use of the inventive adapter.

The difference between the two side plates 402, 404 in FIGS. 14, 15 lies in the relative disposition of the shim 408. In a "left" side plate 404, the shim 408 is attached to one side of the plate, while in the "right" side plate 402, the shim 408 is attached to the other side. Depending on the desired width of the gap between the two side plates during use, the side of the plates 402, 404 on which the shim 408 is oriented relative to the rack frame member may be closer thereto or separated therefrom. Preferably, the shims 408 are welded or spot welded to the side plates 402, 404. To facilitate the alignment of the apertures 410, 412, one or more through pins 60. 160 may be inserted through the apertures as the shims 408 are being welded onto the side plates 402, 404.

As an example, and as shown in the method of use view of the adapters 302, 304 and 402, 404 in FIG. 16, each providing a different engagement point for a shoring post 80, the upper plates 402, 404 are disposed with the shims 408 on the side plates 402, 402 adjacent the side separated from the rack frame member 20. This positioning allows the insertion of a large shackle 480, having ends 482 that are separated by a distance greater than the width of the rack frame member. By aligning the circular engagement aperture 486 with the large circular apertures 414 of each of the two side plates 402, 404 permitting insertion of the engagement pin 120 through all of the apertures 486, 414, thus fixing the large shackle 480 to the adapter 400, which in turn has been robustly connected to the collapsed rack frame member 20. This allows engagement of crevice 84 of shoring post 80 to the large shackle.

The shoring posts 80 are essential tools for first responders, e.g., firemen or security officers. Because of the variety in the types of posts 80 used by the first responders, a possibility exists that available shoring posts 80 have diameters that are larger than expected, that is, larger than the width of the rack frame member 20. Such conditions will render it difficult in this configuration to maneuver the end 82 of a large shoring post into the gap between side plates 402, 404. In that event, the shims 408 come into play, as flipping the side plates 402, 404 so that the shims 408 are disposed with the shim side adjacent the side plate surface (not shown). Such a configuration will increase the width between the two side plates 402, 404 at the engagement end with the large apertures 114 by the width of two shim thicknesses, thereby providing a larger separation that will accommodate a larger shoring post end. The length of engagement pin 120 should be long enough to span the increased separation and still retain the engagement pin in place, including the cotter holes 122, 124, 162, 164 extending beyond the side plate outer surfaces.

One exemplary method of implementation of the inventive adapters 300, 400 is shown in FIGS. 17 and 18, it being understood that any of the above-described embodiments may be substituted for the two adapters 300, 400 shown. The upper and lower adapters 400, 300, respectively are shown in use to provide engagement points of a shoring post 80 and a ratchet strap 90. A first responder to a collapsed pallet rack fame event will first attach the upper adapter 400 at a point where it can provide support to the rack frame member 20. The lower adapter 300 is attached to a low point on the same segment of the pallet rack frame 20, as close to ethe floor a s possible. The anchor 92 is then disposed at a point on the floor directly beneath the rack frame member 20 at a distance from the lower adapter 300 that should ideally be greater than the length of the shoring post 80.

Shoring post 80 then engages the upper adapter at one end 82 and the anchor 92 at a a lower end 88. Once the shoring post end 82 engages the collapsed frame member 20, for example, with the opposite end 88 of shoring post 80 firmly set in place by a robust connection to anchor 92, the ratchet strap 90 is connected to the anchor 92 at one end and to the lower adapter 300 at the other end. The connections can be made by a clasp, a carabiner, or other robust temporary connection. Both the strap 90 and shoring post 80 are slidably attached to metal anchor 92 in a robust connection. Once the connections are made, the ratchet 94 engages the strap 90 to tighten it to a very taut condition so that the anchor 92 is fixed in position and thereby the system provides a triangular attachment and secure support for the collapsed pallet frame member 20. Care must be taken in ratcheting strap 90 so as not to over ratchet the ratchet strap 90 to avoid overstressing the collapsed structure. The triangular configuration of the system thus secures the collapsed pallet rack frame member 20 from further collapse or movement, allowing the first responders to continue with their rescue work.

The invention herein has been described and illustrated with reference to the embodiments of FIGS. 1-18, but it should be understood that the features and operation of the invention as described is susceptible to modification or alteration without departing significantly from the spirit of the invention as disclosed above. For example, the dimensions, size and shape of the various elements may be altered to fit specific applications. Cotter pins may provide a preferable embodiment but may not be absolutely necessary. Accordingly, the specific embodiments illustrated and described herein are for illustrative purposes only and the invention is not limited except by the following claims.

What is claimed is:

1. A shore post engagement adapter for providing an engagement point to a pallet rack frame member, the rack frame member having at least one surface with through apertures, the shore post engagement adapter supports an emergent pallet rack frame collapse, comprising:

a) a proximate side plate having a predetermined thickness, an engagement pin end and a pallet rack frame engagement end, the pallet rack frame engagement end having a predetermined array of small circular apertures and the engagement pin end having at least one large circular aperture;

b) a distal side plate having a predetermined thickness, an engagement pin end and a rack frame engagement end, the rack frame engagement end having an array of small circular apertures and the engagement pin end having at least one large circular engagement aperture;

c) at least two essentially cylindrical through pins sized and dimensioned for engaging at least two small circular apertures; and d) an engagement pin, sized and dimensioned for engaging the engagement aperture, wherein the proximal and distal side plates arrays of small circular apertures that in at least one orientation correspond to an array of through holes disposed in a surface of the rack frame member, such that overlaying the surface of the side plates over the array of through holes permits insertion of one cylindrical through pin through one of the small circular apertures of the proximate side plate, into the through apertures of the rack frame member, and into the small apertures of the distal side plate, which together act in conjunction thereby to firmly and robustly attach the adapter to the frame member, permitting secure engagement of a shoring post to the adapter and to the pallet rack frame member, whereby the shore post engagement adapter supports the emergent pallet rack frame collapse.

2. The shore post engagement adapter according to claim 1 wherein each of the plates are identical in structure and further comprise four edges defining width and length dimensions, and further comprising a thickness substantially smaller than the width and length dimensions.

3. The shore post engagement adapter according to claim 1 wherein the array of small circular apertures further comprises at least two apertures that are spaced apart at a distance corresponding to the distance between at least two through apertures on the array of apertures on the surface of the pallet rack frame member.

4. A shore post engagement adapter provides an engagement point to a pallet rack frame member during a collapse emergency the rack frame member having at least one surface with through apertures and being enabled for use in a stabilizing function, comprising:

a) a proximate side plate having a predetermined thickness, an engagement pin end and a pallet rack frame engagement end, the pallet rack frame engagement end having a predetermined array of small circular apertures and the engagement pin end having at least one large circular aperture;

b) a distal side plate having a predetermined thickness, an engagement pin end and a rack frame engagement end, the rack frame engagement end having an array of small circular apertures and the engagement pin end having at least one large circular engagement aperture;

c) at least two essentially cylindrical through pins sized dimensioned for engaging the at least two small circular apertures; and d) an engagement pin, sized and dimensioned for engaging the engagement aperture, wherein the proximal and distal side plates arrays of small circular apertures that in at least one orientation correspond to an array of through holes disposed in a surface of the rack frame member, such that overlaying the surface of the side plates over the array of through holes permits insertion of one cylindrical through pin through one of the small circular apertures of the proximate side plate, into the through apertures of the rack frame member, and into the small apertures of the distal side plate, which together act in conjunction thereby to firmly and robustly attach the shore post engagement adapter to the frame member, permitting secure engagement of a shoring post to the shore post engagement adapter and to the pallet rack frame member, whereby the shore post engagement adapter provides the engagement point to a pallet rack frame member during a collapse.

* * * * *